US005551157A

United States Patent [19]

Wu

[11] Patent Number: 5,551,157

[45] Date of Patent: Sep. 3, 1996

[54] TOOL HANDLE ASSEMBLY FOR GARDEN TOOLS

[76] Inventor: Chin-Sung Wu, 30, Min Yu St., Lu Kang Town, Changhua, Taiwan

[21] Appl. No.: 442,700

[22] Filed: May 17, 1995

[51] Int. Cl.[6] ..... B26B 13/14

[52] U.S. Cl. ..... 30/341; 30/251; 30/340

[58] Field of Search ..... 30/341, 250, 251, 30/190, 340, 85; 16/110 R, 116 R; 81/177.1, 177.7, 427.5, 489

[56] References Cited

U.S. PATENT DOCUMENTS 3,189,069 6/1965 Stowell ..... 16/116 R X 4,779,342 10/1988 Kobayashi et al. ..... 30/250

*Primary Examiner*—Douglas D. Watts

*Attorney, Agent, or Firm*—Beveridge, DeGrandi, Weilacher & Young, L.L.P.

[57] ABSTRACT

A tool handle assembly including a first handgrip to hold a pair of cutting blades, a second handgrip pivoted to the first handgrip and moved to operate the cutting blades, wherein the first handgrip comprises a longitudinal top side, two longitudinal rows of mounting holes bilaterally disposed on the longitudinal top side, two smoothly curved tail wings bilaterally disposed at one end, two projecting blocks inwardly projecting from the tail wings, a rectangular opening defined between the projecting blocks, a rectangular locating hole disposed behind the projecting blocks, and a cushion covered on the top side, the cushion having two longitudinal rows of mounting blocks bilaterally disposed at a bottom side thereof and respectively fitted into the rows of mounting holes, a longitudinal locating rib fitted into the rectangular opening between the projecting blocks, a plurality of transverse spring ribs raised from the bottom side between the rows mounting blocks and stopped against the top side of the first handgrip, and an end hook hooked in the rectangular locating hole.

4 Claims, 9 Drawing Sheets

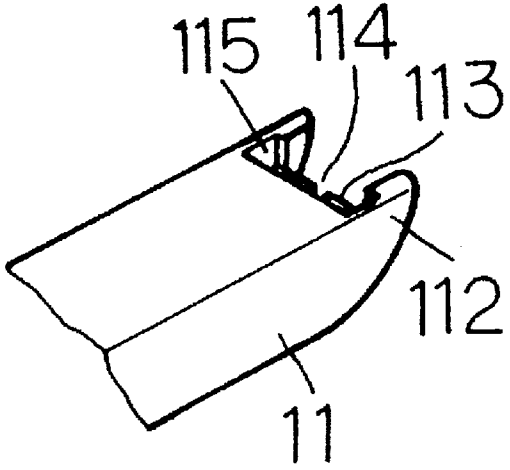
FIG. 3
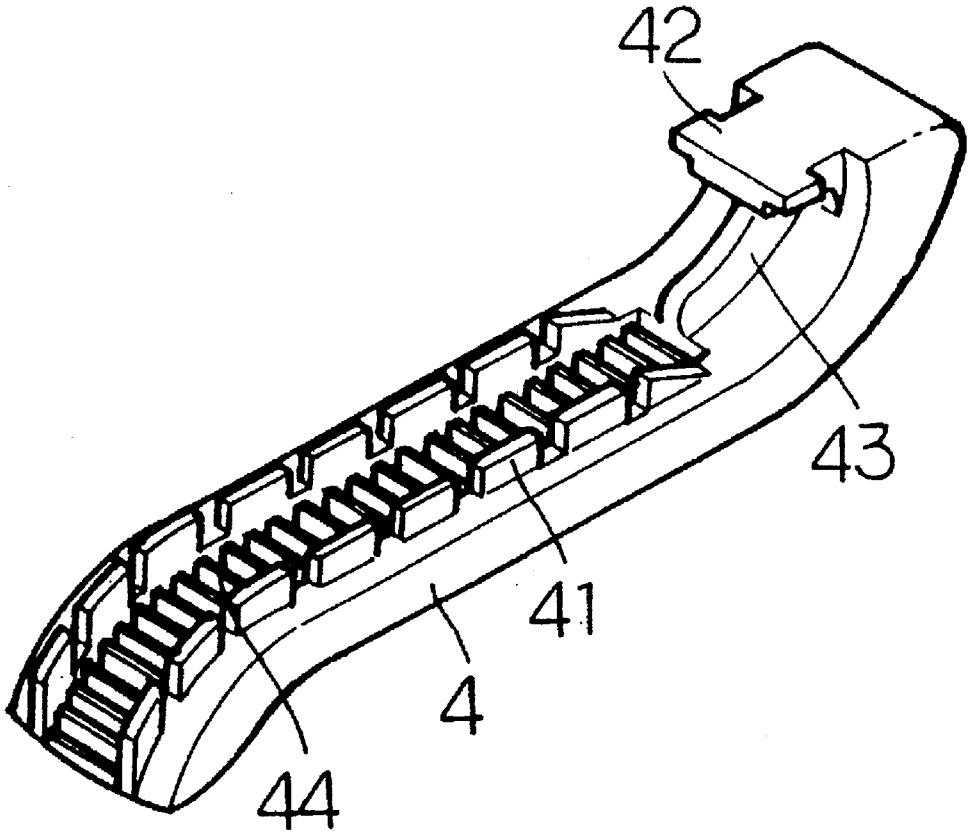
FIG. 2-A

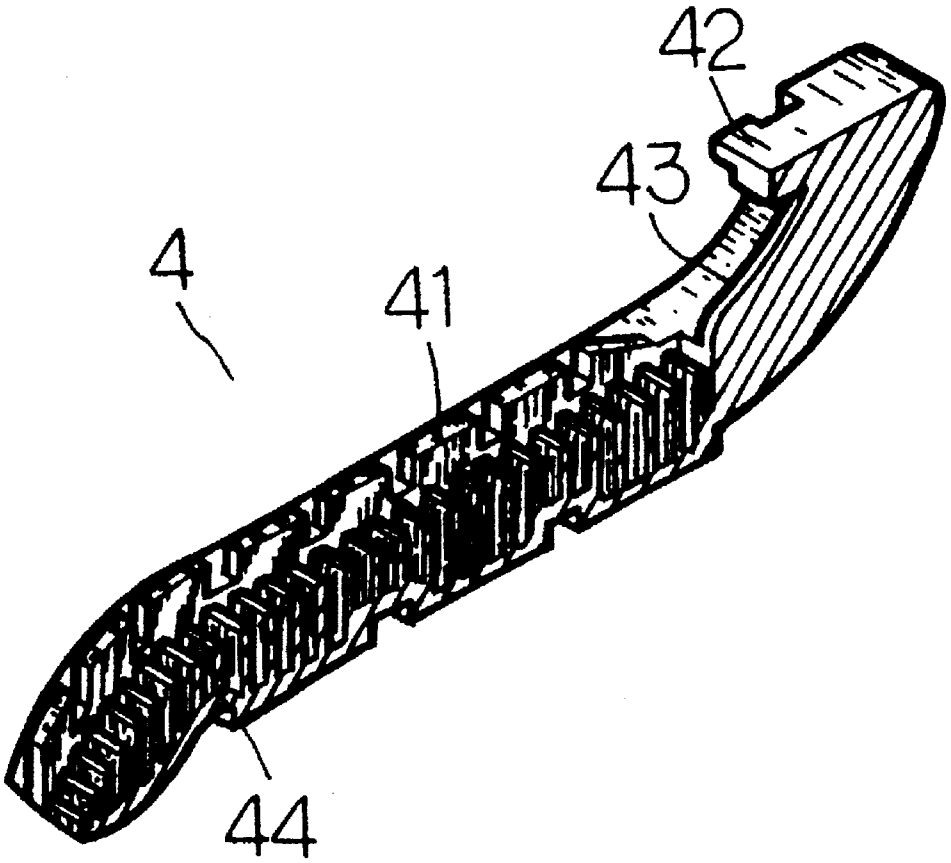
FIG. 2-B

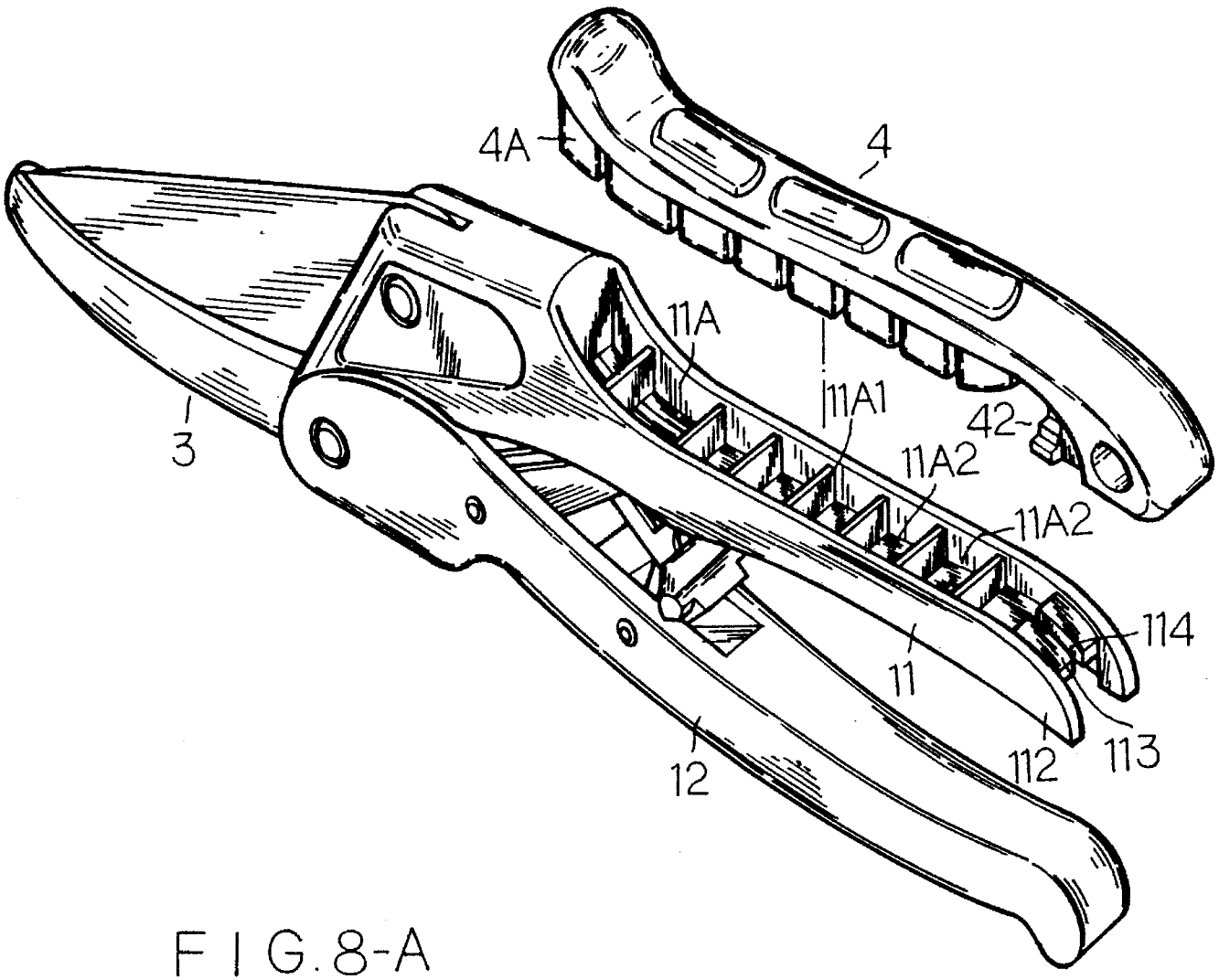
FIG. 8-A

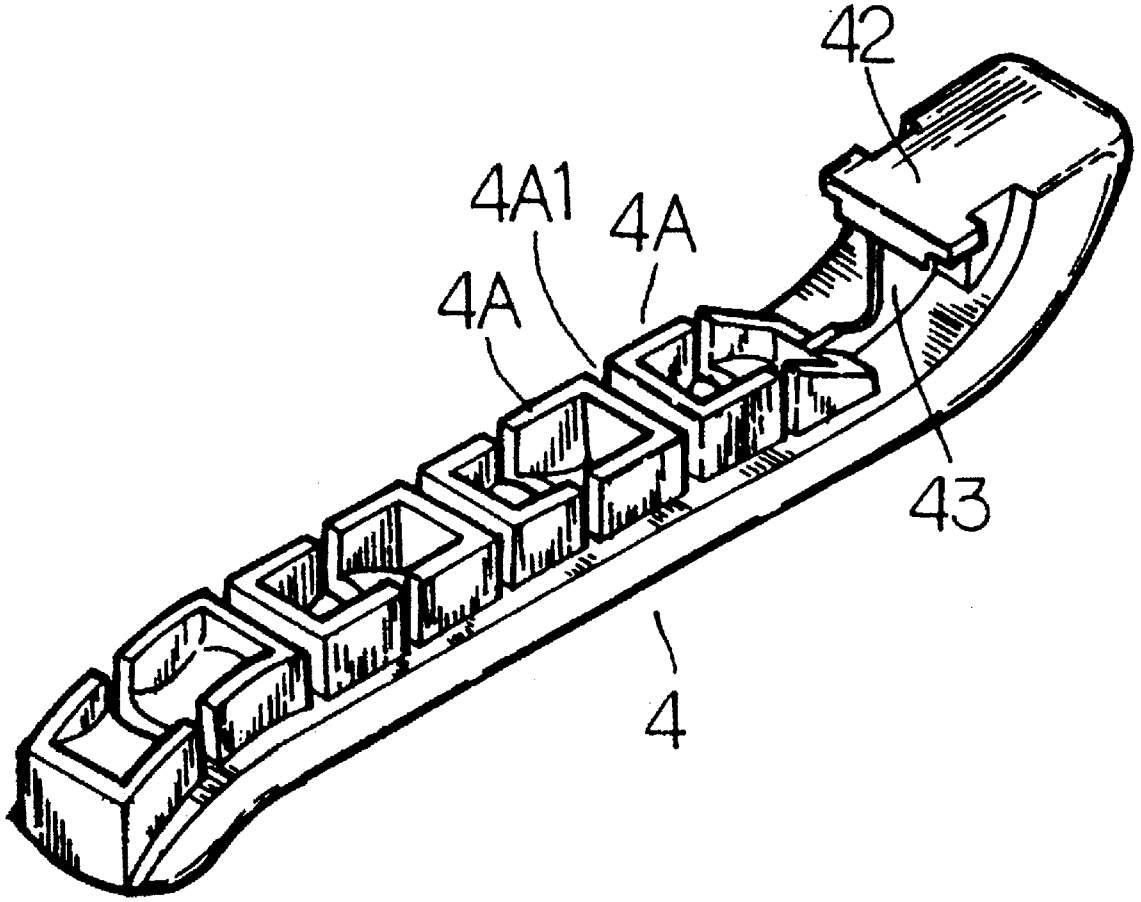
FIG. 8-B

TOOL HANDLE ASSEMBLY FOR GARDEN TOOLS

BACKGROUND OF THE INVENTION

The present invention relates to tool handles, and relates more particularly to a tool handle assembly for garden tools which has a cushion on at the top side that can be compressed and released to comfort the hand when the tool is operated.

Regular cutting tools for gardening commonly comprise a first handgrip to hold a pair of cutting blades, a second handgrip pivoted to the first handgrip and moved relative to the first handgrip in opening and closing the cutting blades for cutting things, and a compression spring connected between the first handgrip and the second handgrip. Frequently gripping the rigid surface of the handle of a garden tool will cause pain to the hands. Furthermore, the skin of the hand will be injured easily after a long length of time in operating the tool.

SUMMARY OF THE INVENTION

The present invention has been accomplished to provide a tool handle assembly for garden tools which eliminates the aforesaid problems. According to one embodiment of the present invention, the tool handle assembly comprises a first handgrip to hold a pair of cutting blades, a second handgrip pivoted to the first handgrip and moved to operate the cutting blades, wherein the first handgrip comprises a longitudinal top side, two longitudinal rows of mounting holes bilaterally disposed on the longitudinal top side, two smoothly curved tail wings bilaterally disposed at one end, two projecting blocks inwardly projecting from the tail wings, a rectangular opening defined between the projecting blocks, a rectangular locating hole disposed behind the projecting blocks, and a cushion covered on the top side, the cushion having two longitudinal rows of mounting blocks bilaterally disposed at a bottom side thereof and respectively fitted into the rows of mounting holes, a longitudinal locating rib fitted into the rectangular opening between the projecting blocks, a plurality of transverse spring ribs raised from the bottom side between the rows mounting blocks and stopped against the top side of the first handgrip, and an end hook hooked in the rectangular locating hole. As an alternate form of the present invention, the cushion is fixed to the first handgrip by fitting the respective mounting blocks into the respective mounting holes, the tail wings and projecting blocks are eliminated from the first handgrip, and the longitudinal locating rib and end hook are eliminated from the cushion.

BRIEF DESCRIPTION OF THE DRAWINGS

FIG. 2A shows the bottom structure of the cushion shown in FIG. 1;

FIG. 2B is a sectional view of the cushion shown in FIG. 2A;

FIG. 3 is en enlarged view of the rear section of the first handgrip shown in FIG. 1;

FIG. 8A is an exploded view of another alternate form of the present invention;

FIG. 8B shows the bottom structure of the cushion shown in FIG. 8A; and

DETAILED DESCRIPTION OF THE PREFERRED EMBODIMENT

Figure 1:
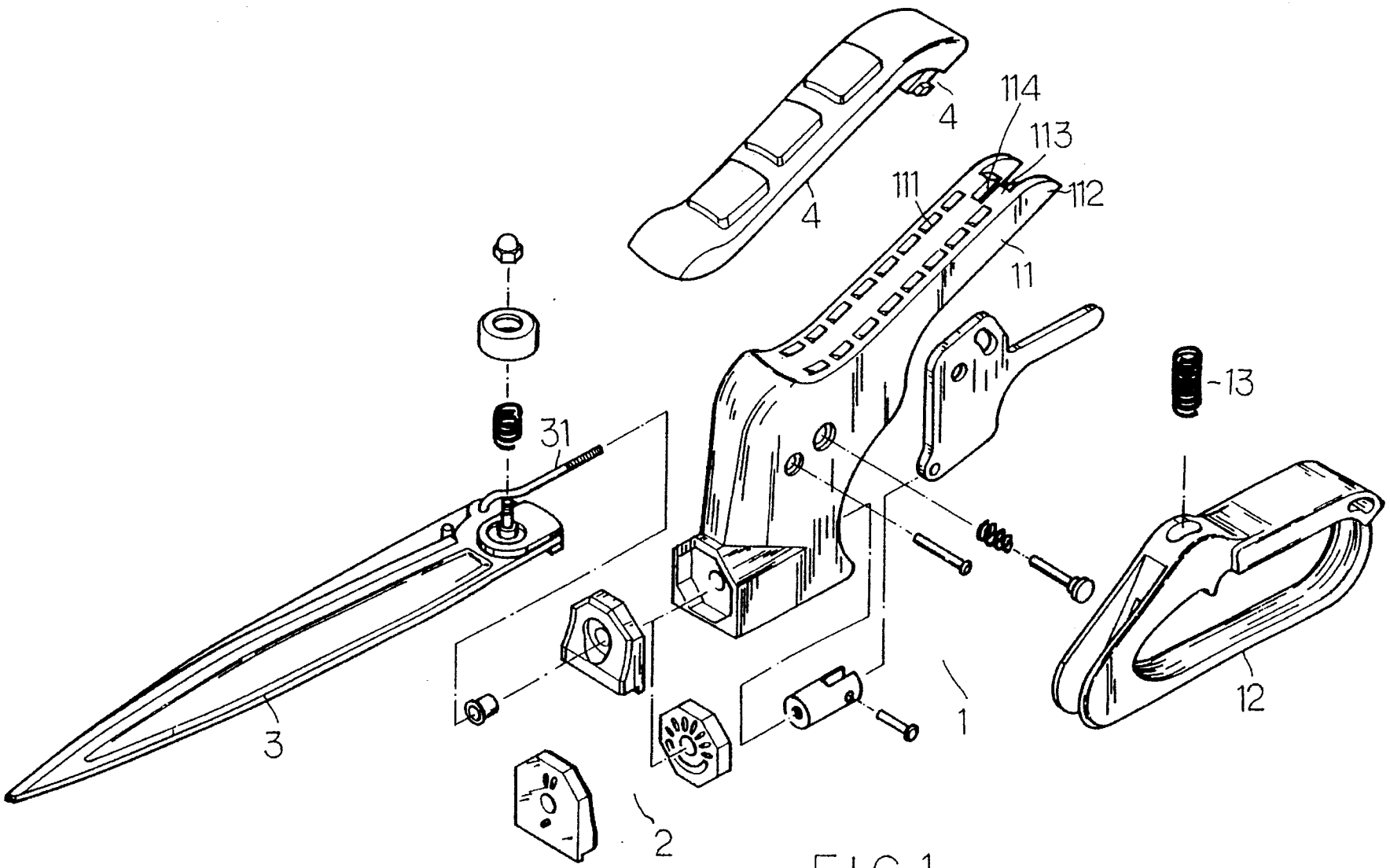
FIG. 1 is an exploded view of a garden tool constructed according to the present invention.
Figure 4:
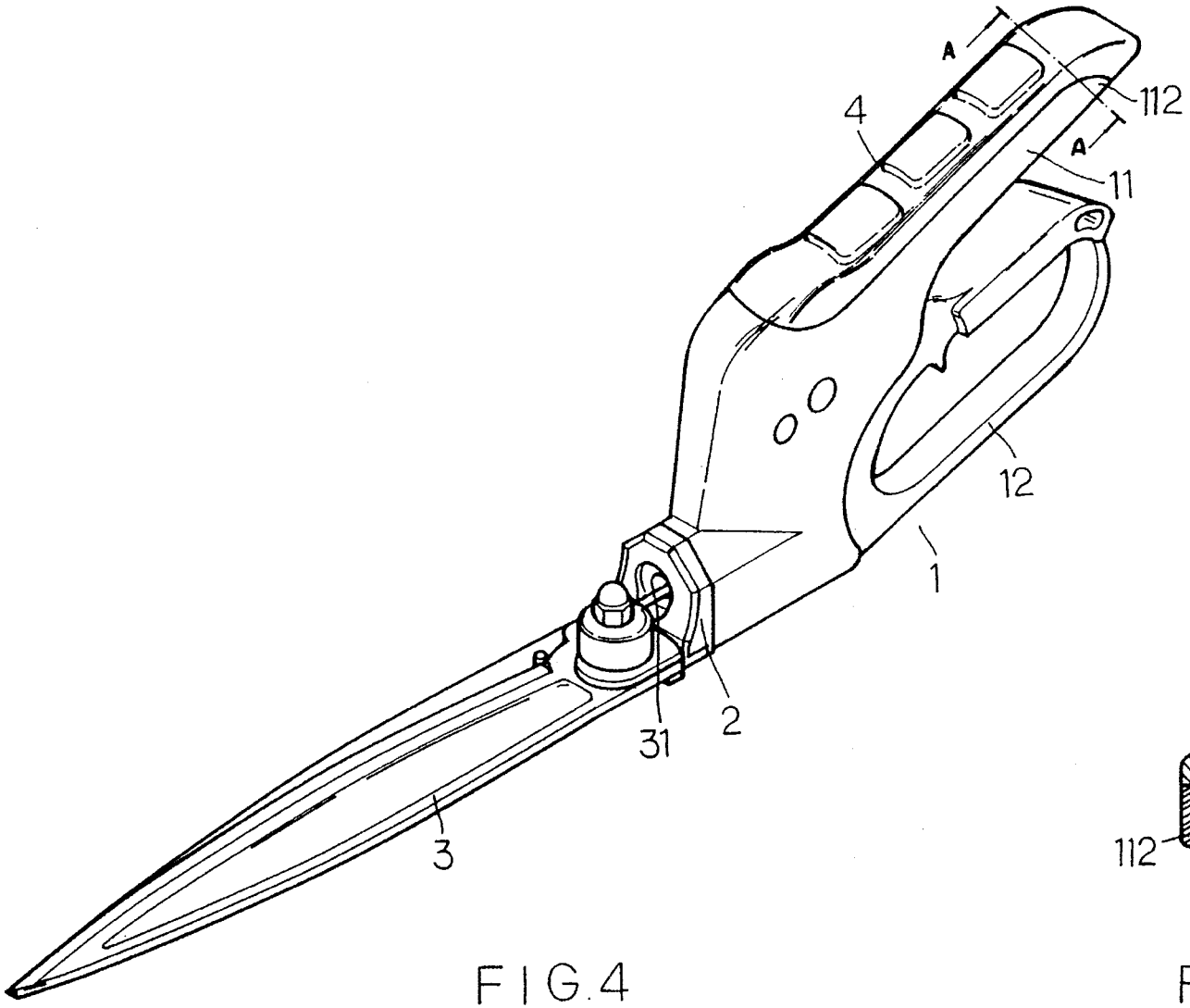
FIG. 4 is ah assembly view of FIG. 1.
Figure 5:
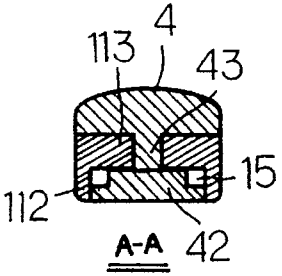
FIG. 5 is a cross sectional view taken along line A—A of FIG. 4.

Referring to FIGS. 1, 2A, 2B, 3, 4, and 5, a garden tool is shown comprised of an operating handle 1, a rotary member 2, a pair of scissors blades 3, and a cushion 4. The scissors blades 3 are connected to the handle 1 by a link 31 and operated by the operating handle 1. The operating handle 1 is comprised of a first handgrip 11, a second handgrip 12 pivoted to the first handgrip 11, and a compression spring 13 connected between the first handgrip 11 and a second handgrip 12. The first handgrip 11 comprises two longitudinal rows of mounting holes 111 at the top, two smoothly curved tail wings 112 bilaterally disposed at one end remote from the rotary member 2, two projecting blocks 113 inwardly projecting from the tail wings 112, a rectangular opening 114 defined between the projecting blocks 1 13, and a rectangular locating hole 115 disposed behind the projecting blocks 113 and communicated with the rectangular opening 114 (see FIG. 3). The cushion 4 fits the top side of the first handgrip 11, comprising two longitudinal rows of mounting blocks 41 bilaterally disposed at the bottom and respectively fitted into the rows of mounting holes 111 on the first handgrip 11, a plurality of transverse spring ribs 44 disposed between the mounting blocks 41 and stopped against the top side of the first handgrip 11, a longitudinal locating rib 43 at the bottom near one end fitted into the rectangular opening 114 between the projecting blocks 113, and an end hook 42 hooked in the rectangular locating hole 115 (see FIGS. 2A, 2B, and 5). Because the cushion 4 is mounted on the first handgrip 11 and the transverse spring ribs 44 of the cushion 4 are stopped at the top side of the first handgrip 11, when the operating handle 1 is operated to move the second handgrip 12 relative to the first handgrip 11, the transverse spring ribs 44 are alternatively compressed and released to buffer the pressure. Therefore, the operating handle 1 is comfortable in operation.

Figure 6:
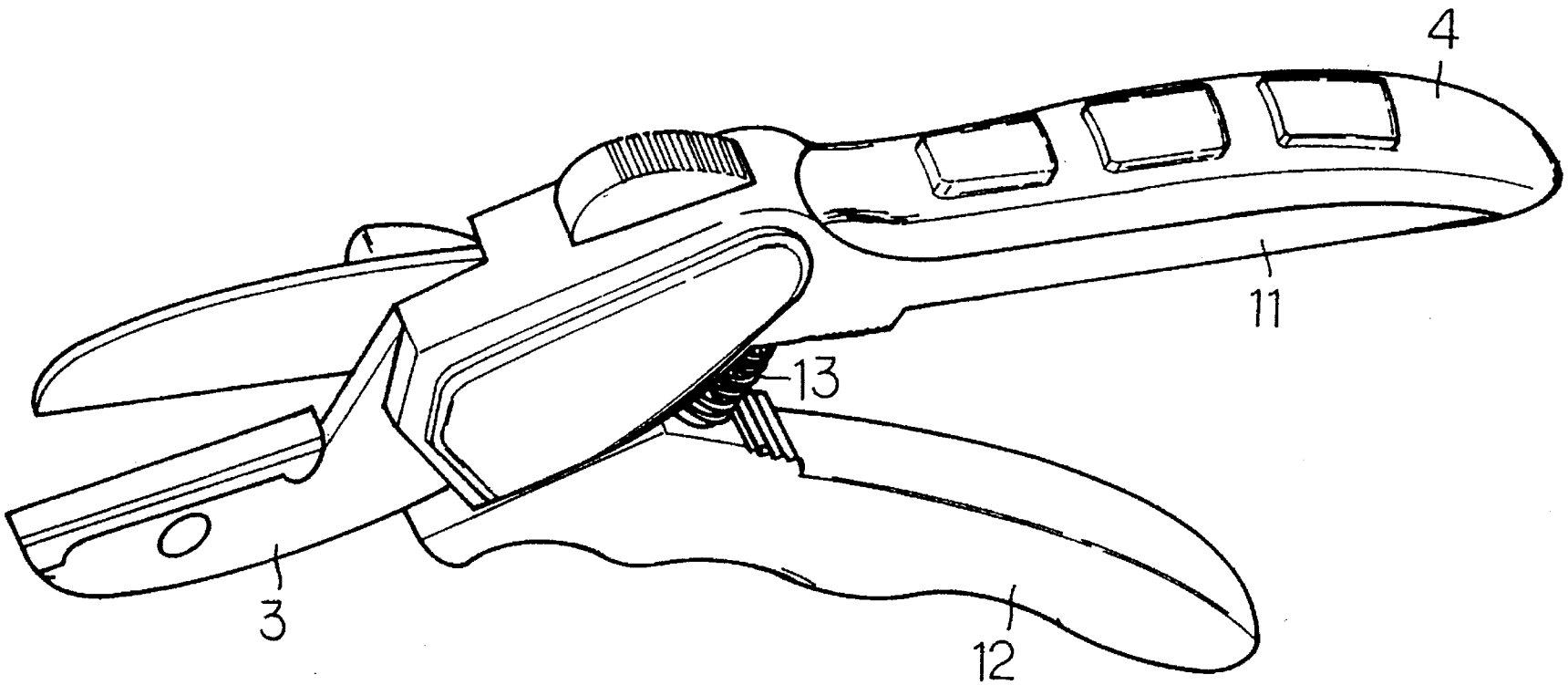
FIG. 6 shows another structure of garden tool constructed according to the present invention.

The present invention can be applied to any of a variety of garden tools. For example, FIG. 6 shows the aforesaid structure installed in another structure of cutting tool.

Figure 7:
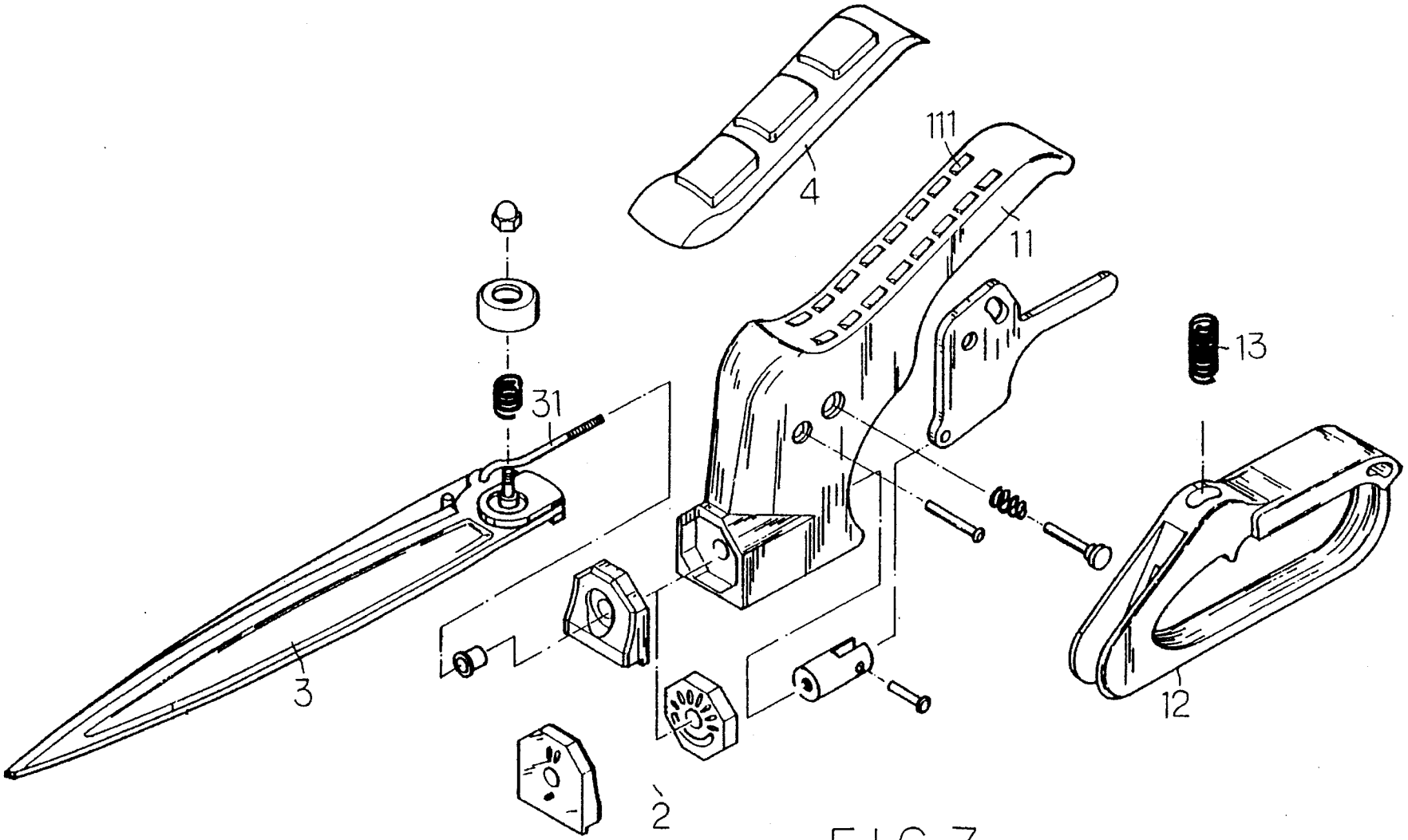
FIG. 7 is an exploded view of an alternate form of the present invention.
Figure 9:
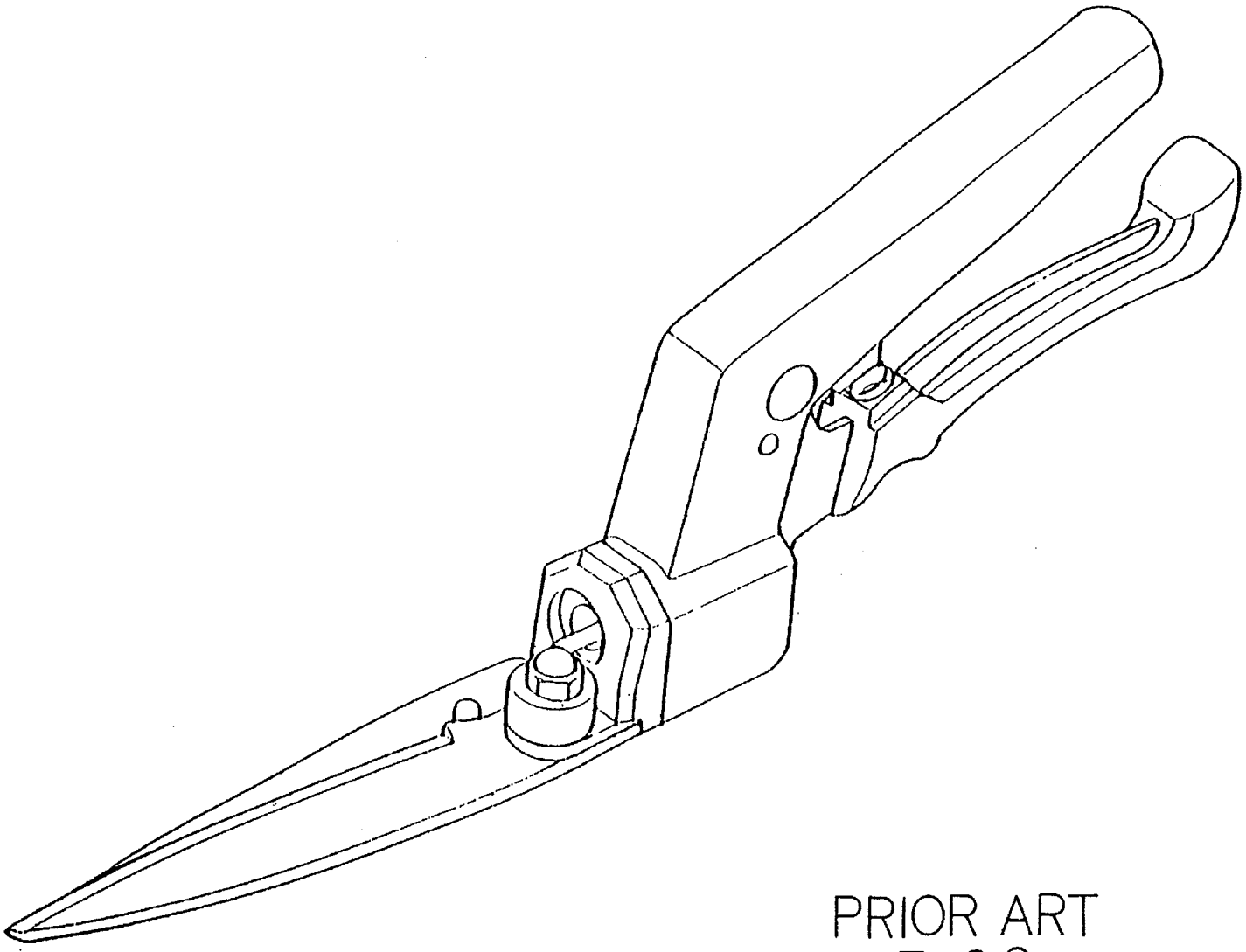
PRIOR ART FIG.9
FIG. 9 shows a garden tool incorporated with a handle according to the prior art.

FIG. 7 shows an alternate form of the present invention, in which the cushion 4 is fixed to the first handgrip 11 by fitting the respective mounting blocks 41 into the respective mounting holes 111. This alternate form eliminates the aforesaid tail wings 112, projecting blocks 113, a rectangular opening 114, and rectangular locating hole 115 from the first handgrip 11, and the aforesaid ! longitudinal locating rib 43 and end hook 42 from the cushion 4.

FIGS. 8A and 8B show another alternate form of the present invention. According to this alternate form, the first handgrip 11 comprises a longitudinal top chamber 11A at the top side, a plurality of transverse partition plates 11A1 disposed in the longitudinal top chamber 11A and defining a longitudinal series of mounting holes 11A2 within the longitudinal top chamber 11A; the cushion 4 comprises a longitudinal series of hollow bottom projecting blocks 4A respectively fitted into the mounting holes 11A2 on the first handgrip 11, and a plurality of gaps 4A1 between the projecting blocks 4A which receive the partition plates 11A1 respectively.

It is to be understood that the drawings are designed for purposes of illustration only, and are not intended as a definition of the limits and scope of the invention disclosed.

I claim:

1. A tool handle assembly comprising a first handgrip to hold a pair of cutting blades, a second handgrip pivoted to said first handgrip and moved relative to said first handgrip in opening and closing said cutting blades for cutting things, and a compression spring connected between said first handgrip and said second handgrip, wherein said first handgrip comprises a longitudinal top side, two longitudinal rows of mounting holes bilaterally disposed on said longitudinal top side, two smoothly curved tail wings bilaterally disposed at one end, two projecting blocks inwardly projecting from said tail wings, a rectangular opening defined between said projecting blocks, a rectangular locating hole disposed behind said projecting blocks and communicated with said rectangular opening, and a cushion on said top side, said cushion comprising two longitudinal rows of mounting blocks bilaterally disposed at a bottom side thereof and respectively fitted into said rows of mounting holes, a longitudinal locating rib fitted into said rectangular opening between said projecting blocks, and an end hook hooked in said rectangular locating hole.

2. The tool handle assembly of claim 1 wherein said cushion further comprises a plurality of transverse spring ribs disposed between said mounting blocks and stopped against said top side.

3. A tool handle assembly comprising a first handgrip to hold a pair of cutting blades, a second handgrip pivoted to said first handgrip and moved relative to said first handgrip in opening and closing said cutting blades for cutting things, and a compression spring connected between said first handgrip and said second handgrip, wherein said first handgrip comprises a longitudinal top side, two longitudinal rows of mounting holes bilaterally disposed on said longitudinal top side, and a cushion on said top side, said cushion comprising two longitudinal rows of mounting blocks bilaterally disposed at a bottom side thereof and respectively fitted into said rows of mounting holes, wherein said cushion further comprises a plurality of transverse spring ribs disposed between said mounting blocks and stopped against said top side.

4. A tool handle assembly comprising a first handgrip to hold a pair of cutting blades, a second handgrip pivoted to said first handgrip and moved relative to said first handgrip in opening and closing said cutting blades for cutting things, and a compression spring connected between said first handgrip and said second handgrip, wherein said first handgrip comprises a longitudinal top side, a longitudinal top chamber on said top side, a plurality of transverse partition plates disposed in said longitudinal top chamber and defining a longitudinal series of mounting holes within said longitudinal top chamber, and a cushion on said top side, said cushion comprising a longitudinal series of hollow bottom projecting blocks respectively fitted into said mounting holes, and a plurality of gaps spaced from one another by said projecting blocks which receive said partition plates respectively.

* * * * *